US010885730B2

(12) United States Patent
Kim

(10) Patent No.: US 10,885,730 B2
(45) Date of Patent: Jan. 5, 2021

(54) METHOD FOR SHIPPING AND HANDLING OF GOODS BASED ON AUTOMATICALLY OPERATED, DUAL-ACCESS STORAGE BOXES

(71) Applicant: Han Bin Kim, Milpitas, CA (US)

(72) Inventor: Han Bin Kim, Milpitas, CA (US)

( * ) Notice: Subject to any disclaimer, the term of this patent is extended or adjusted under 35 U.S.C. 154(b) by 0 days.

(21) Appl. No.: 16/509,805

(22) Filed: Jul. 12, 2019

(65) Prior Publication Data

US 2020/0020189 A1 Jan. 16, 2020

Related U.S. Application Data

(60) Provisional application No. 62/698,245, filed on Jul. 15, 2018.

(51) Int. Cl.
*G07C 9/00* (2020.01)

(52) U.S. Cl.
CPC . *G07C 9/00896* (2013.01); *G07C 2009/0092* (2013.01)

(58) Field of Classification Search
CPC ..... G07C 9/00896; G07C 2009/0092; G07C 9/27; G07C 9/00571; G07C 2009/0088; G07C 2209/08; G07F 17/12; G07F 5/26; A47G 29/141; A47G 2029/149; A47G 29/20
USPC ..... 340/5.54, 5.73, 568.1
See application file for complete search history.

(56) References Cited

U.S. PATENT DOCUMENTS 6,204,763 B1 * 3/2001 Sone ..... A47G 29/141 221/2
6,344,796 B1 * 2/2002 Ogilvie ..... G07F 17/12 340/568.1
10,251,503 B1 4/2019 Fulps
2001/0045449 A1 * 11/2001 Shannon ..... G07C 9/21 232/19
2001/0050615 A1 * 12/2001 Kucharczyk ..... A47G 29/141 340/568.1

(Continued)

OTHER PUBLICATIONS

"Amazon Locker", https://www.amazon.com/primeinsider/tips/amazon-locker-qa.html.

*Primary Examiner* — Edwin C Holloway, III

(57) ABSTRACT

A method for shipping and handling of goods based on automatically operated, dual-access storage boxes is provided with at least one computerized dual-access storage box, at least one vehicle-authentication module, a central server module, and at least one courier vehicle. the vehicle-authentication module performs an authentication process on the courier vehicle goes for conditional access to the computerized dual-access storage box. The central server module receives an authentication request from the vehicle-authentication module. Accordingly, the vehicle-authentication module performs a first unlock event, if the courier vehicle is granted an authentication confirmation. This automatically opens a vehicle-side door for delivery of a cargo. Similarly, the central server module receives a user unlocking request. Accordingly, the central server module performs a second unlock event if the user unlocking request is verified. Further, the central server module executes the second unlock command wherein a recipient-side door is automatically opened.

10 Claims, 15 Drawing Sheets

(56) References Cited

U.S. PATENT DOCUMENTS

| | | | | |
|---|---|---|---|---|
| 2002/0103653 | A1* | 8/2002 | Huxter | G06Q 30/0601 705/330 |
| 2002/0147919 | A1* | 10/2002 | Gentry | G07F 7/00 726/2 |
| 2004/0243426 | A1 | 12/2004 | Hashimoto | |
| 2006/0087427 | A1* | 4/2006 | Le | A63H 18/026 340/539.13 |
| 2009/0201198 | A1* | 8/2009 | Moudy | G06Q 10/087 342/357.75 |
| 2015/0379464 | A1* | 12/2015 | Turner | G07F 17/12 705/339 |
| 2016/0140496 | A1* | 5/2016 | Simms | B64C 39/024 705/337 |
| 2016/0235236 | A1* | 8/2016 | Byers | A47G 29/141 |
| 2017/0213187 | A1* | 7/2017 | Choi | A47G 29/141 |
| 2018/0089917 | A1* | 3/2018 | Obaidi | G06K 9/6201 |
| 2019/0004539 | A1 | 1/2019 | Yu | |

* cited by examiner

METHOD FOR SHIPPING AND HANDLING OF GOODS BASED ON AUTOMATICALLY OPERATED, DUAL-ACCESS STORAGE BOXES

The current application claims a priority to the U.S. Provisional Patent application Ser. No. 62/698,245 filed on Jul. 15, 2018.

FIELD OF THE INVENTION

The present invention generally relates to a method for shipping and handling of goods based on automatically operated, dual-access storage boxes. More specifically, the present invention is a method for performing an authentication process for a computerized dual-access storage box and accordingly granting conditional access by automatically opening a vehicle-side door or a recipient-side door of the storage box.

BACKGROUND OF THE INVENTION

Unmanned storage boxes can be used for facilities such as apartments or buildings where people are concentrated. With a conventional unmanned storage box, a delivery person directly delivers the goods to the storage box and the receiver collects the goods. In existing storage boxes, the courier is responsible for opening and placing the cargo into the storage box. This often requires the courier to get out of the vehicle and physically transport the cargo into the box. Overall, this greatly increases the time requires to load the cargo and often leading to backup and congestion at the unloading area.

The present invention has been made to solve the aforementioned problems. The present invention introduces a computerized dual-access storage box mounted to the curbside of a road, that is accessible from a courier vehicle out of the side window. With this scheme, overall delivery time can be greatly reduced. Furthermore, the present invention also includes provisions for unmanned autonomous vehicles, which can lead to further reductions in transportation costs. With the autonomous courier vehicle and its operation system, the delivery cycle can be much shorter, and the transportation can be performed more effectively due to the fully automated machine configuration.

Accordingly, the present invention is a method of shipping and handling of goods based on computerized dual-access storage boxes. To achieve this, the present invention may utilize a computerized dual-access storage box and an automated authentication system that is directly accessible from a courier vehicle. The system includes authentication device allowing autonomous or manned vehicle conditional access to the storage box, automatic opening and closure of a door of the storage box to enable autonomous delivery, and control of delivery and retrieving.

DETAILED DESCRIPTION OF THE INVENTION

All illustrations of the drawings are for the purpose of describing selected versions of the present invention and are not intended to limit the scope of the present invention.

Figure 1:
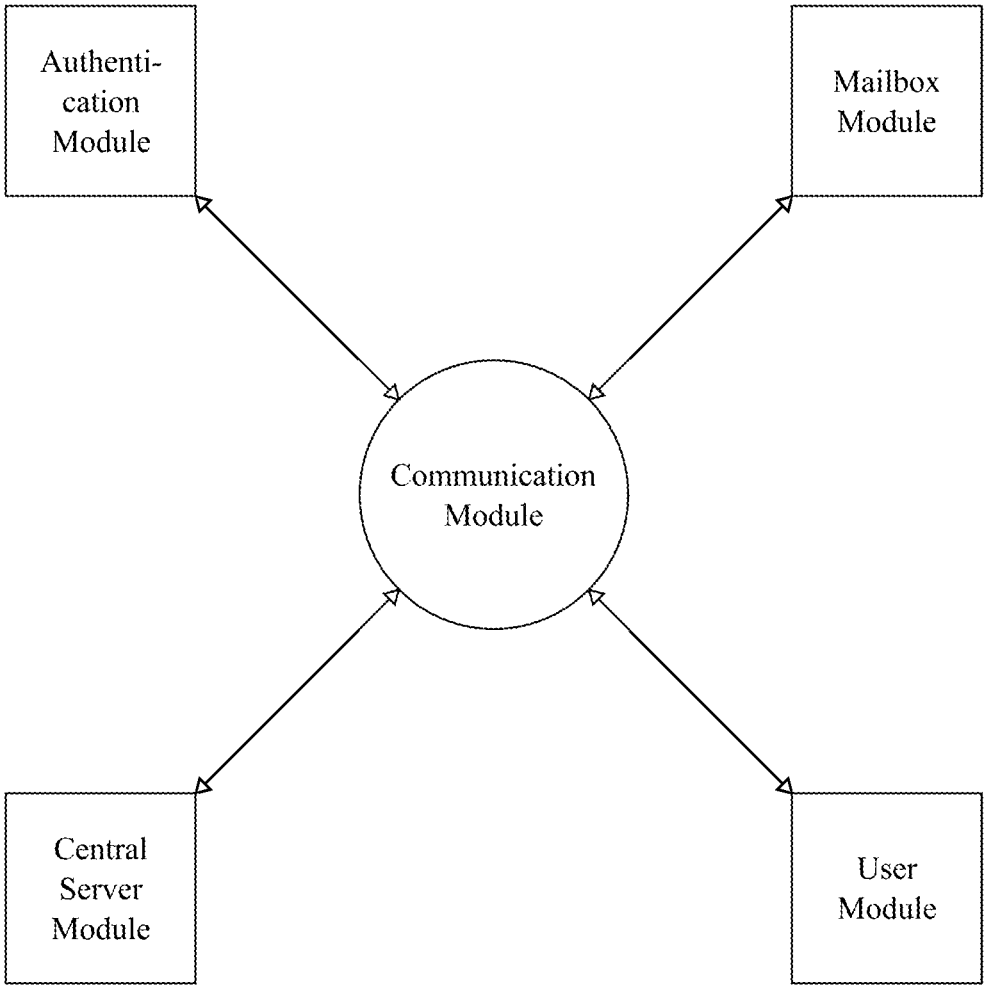
FIG. 1 is a schematic diagram of the overall system of the present invention.
Figure 5A:
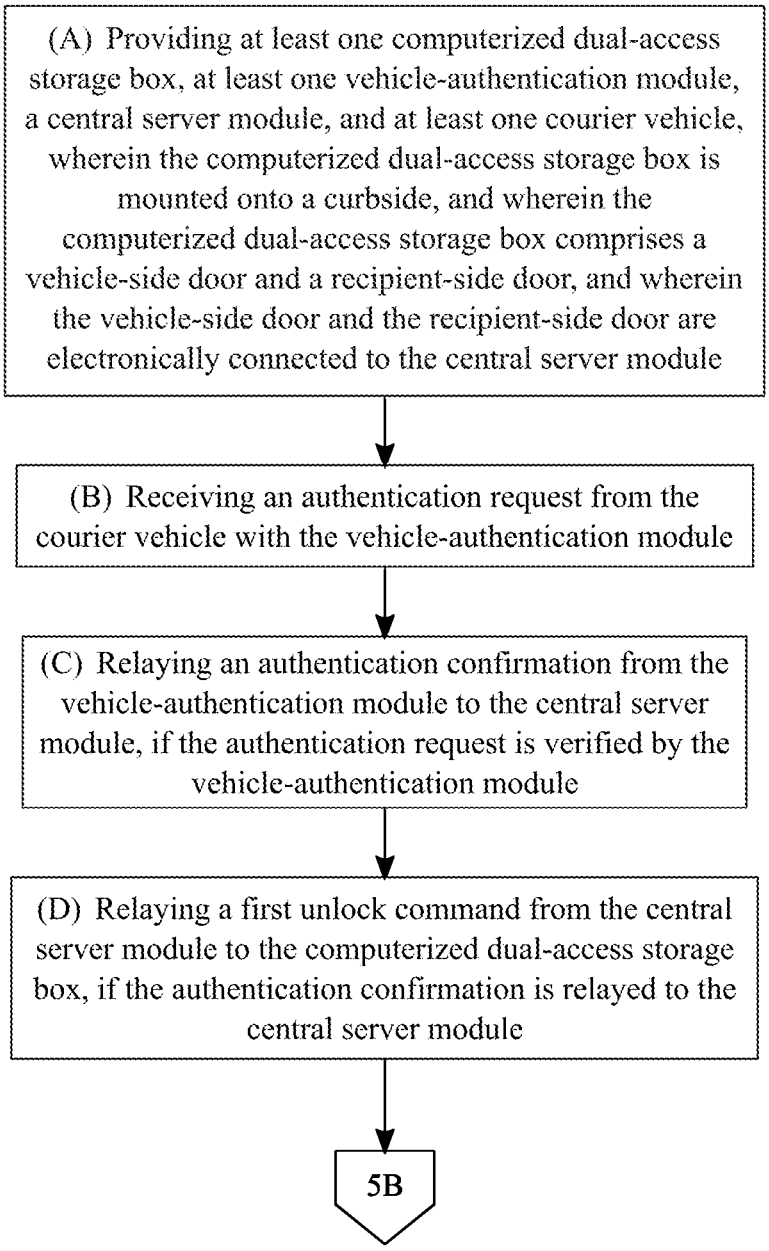
FIG. 5A is a schematic diagram illustrating the overall process of the present invention.
Figure 5B:
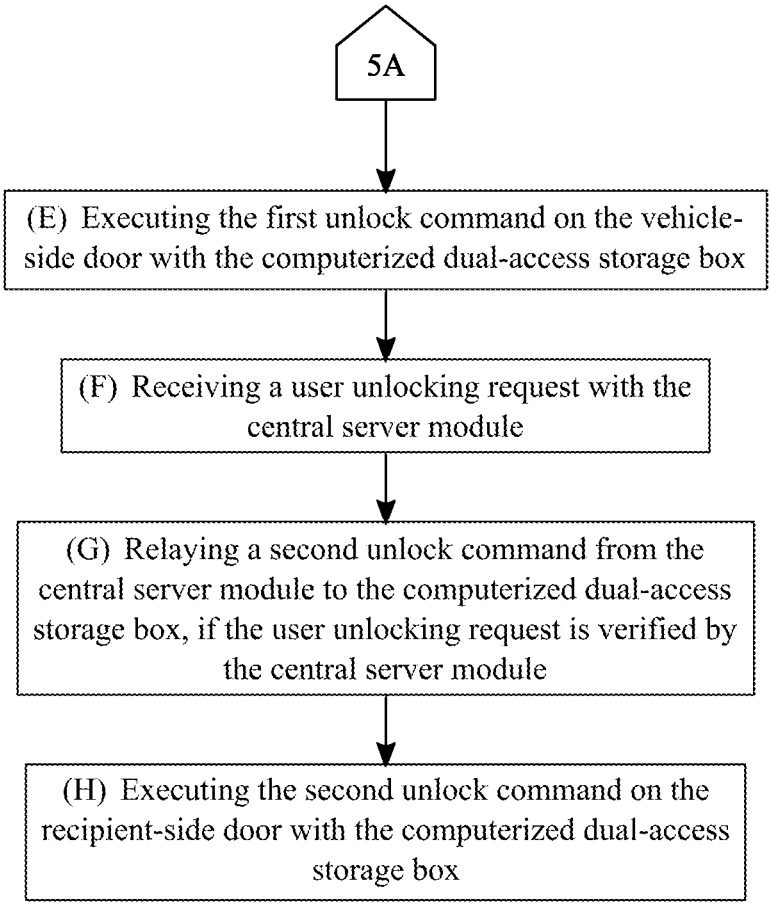
FIG. 5B is a flowchart illustrating the process for relaying and executing the second unlock command.

The present invention is a method for shipping and handling of goods based on automatically operated, dual-access storage boxes. The storage boxes are directly accessible from a delivery vehicle or a human. This facilitates rapid unloading of cargo from the vehicle into the respective storage box. Referring to FIG. 1, FIG. 5A, and FIG. 5B, the method of the present invention is provided with at least one computerized dual-access storage box, at least one vehicle-authentication module, a central server module, and at least one courier vehicle, wherein the computerized dual-access storage box is mounted onto a curbside, and wherein the computerized dual-access storage box comprises a vehicle-side door and a recipient-side door, and wherein the vehicle-side door and the recipient-side door are electronically connected to the central server module (Step A).

The computerized dual-access storage box is a courier box comprising a vehicle-side door and a recipient-side door allowing direct access from the courier vehicle on the driveway. Existing courier boxes require the driver of the courier vehicle to manually open the courier box after passing an authentication process. In contrast, in the present invention, the computerized dual-access storage box is opened automatically after authentication. This allows goods to be transferred directly from the courier vehicle, thus expediting the loading process. In the same vein, the computerized dual-access storage box is mounted to the curbside of the road allowing direct operation from within the courier vehicle.

Similarly, the vehicle-authentication module is also provided on a curbside next to the computerized storage box to facilitate direct operation from the courier vehicle. Accordingly, the vehicle-authentication module receives an authentication request from the courier vehicle (Step B). In one embodiment, the vehicle-authentication module receives an authentication request from a manual input device. In another embodiment, the vehicle-authentication module receives the authentication request through a wireless device mounted onto the courier vehicle itself. As such, the central server module processes the authentication request and accordingly operates the computerized dual-access storage box. Further, the vehicle-authentication module relays an authentication confirmation to the central server module, if the authentication request is verified by the vehicle-authentication module (Step C). Accordingly, the central server module relays a first unlock command to the computerized dual-access storage box, if the authentication confirmation is relayed to the central server module (Step D).

In the preferred embodiment, the authentication confirmation is generated by the central server module based on the schedule maintained within a central system. In one embodiment, the central server module may be locally situated in close proximity to the computerized dual-access storage box. Alternately, the central server module may be remotely situated and connected to the computerized dual-access storage box via the internet. Accordingly, the central server module is responsible for keeping track of the recipient for the cargo, selecting the computerized dual-access storage box for a specific cargo, assigning a courier vehicle for the cargo, scheduling the drop off, and granting authorization to the courier vehicle. As such, the computerized dual-access storage box executes the first unlock command on the vehicle-side door (Step E).

Alternately, the central server module is also responsible for operating the recipient-side door. As such, the central server module receives a user unlocking request (Step F). Preferably, the user unlocking request is generated by an electronic device owned by the user such as a smartphone or a tablet. In one embodiment, the user unlocking request may be received via a near field communication (NFC) card embedded into the computerized dual-access storage box. Alternately, the user unlocking request may be transmitted directly to the central server module via the device. Once received, the central server module processes the user unlocking request and accordingly controls the recipient-side door of the computerized dual-access storage box. As such, the central server module relays a second unlock command to the computerized dual-access storage box, if the user unlocking request is verified by the central server module (Step G). Accordingly, the computerized dual-access storage box executes the second unlock command on the recipient-side door (Step H). Like the vehicle-side door, the recipient side door opens automatically when computerized dual-access storage box executes the second unlock command. This allows a recipient to access the computerized dual-access storage box and retrieve the cargo.

Figure 6:
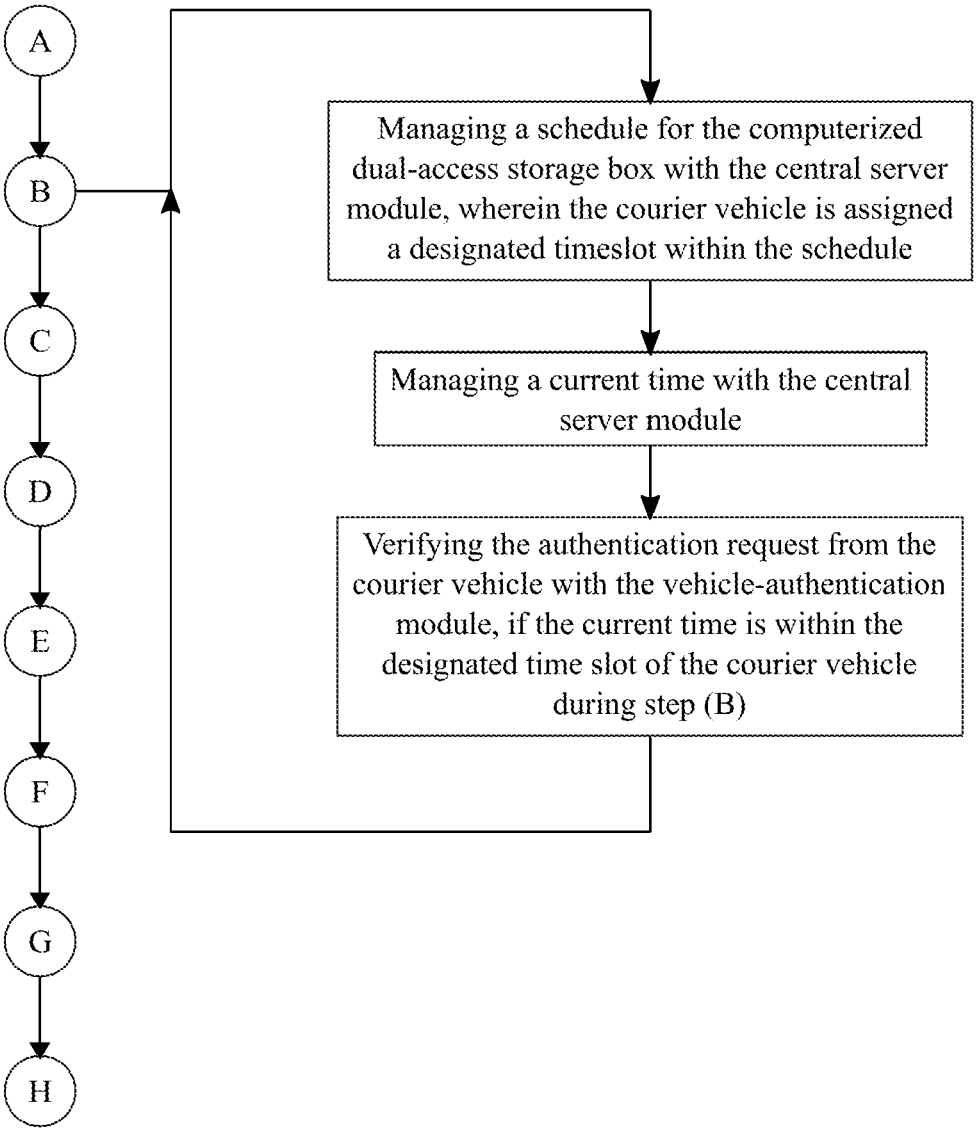
FIG. 6 is a flowchart illustrating the process for executing the vehicle-authentication process.

Referring to FIG. 6, in the preferred embodiment, the authentication process depends on the scheduled drop off time of the courier vehicle. If the courier vehicle doesn't deliver the cargo at the scheduled time, the courier vehicle fails the authentication process. As such, the central server module manages a schedule for the computerized dual-access storage box, wherein the courier vehicle is assigned a designated timeslot within the schedule. The schedule is continually updated based on the orders received by the central server module. As such, each order is assigned to a courier vehicle and given a time slot within the schedule. During the authentication process, the central server module determines if the cargo is delivered at the designated timeslot. As such, the central server module manages a current time. The current time is the instantaneous time as recorded by the central server module. As such, the current time may correspond to the specific time zone in which the computerized dual-access storage box is located in. This synchronizes the computerized dual-access storage box to the clocks used by the courier vehicle. Accordingly, the vehicle-authentication module verifies the authentication request from the courier vehicle, if the current time is within the designated time slot of the courier vehicle during step B. More specifically, the authentication confirmation is granted if the courier vehicle delivers the cargo within the designated time slot.

Figure 7:
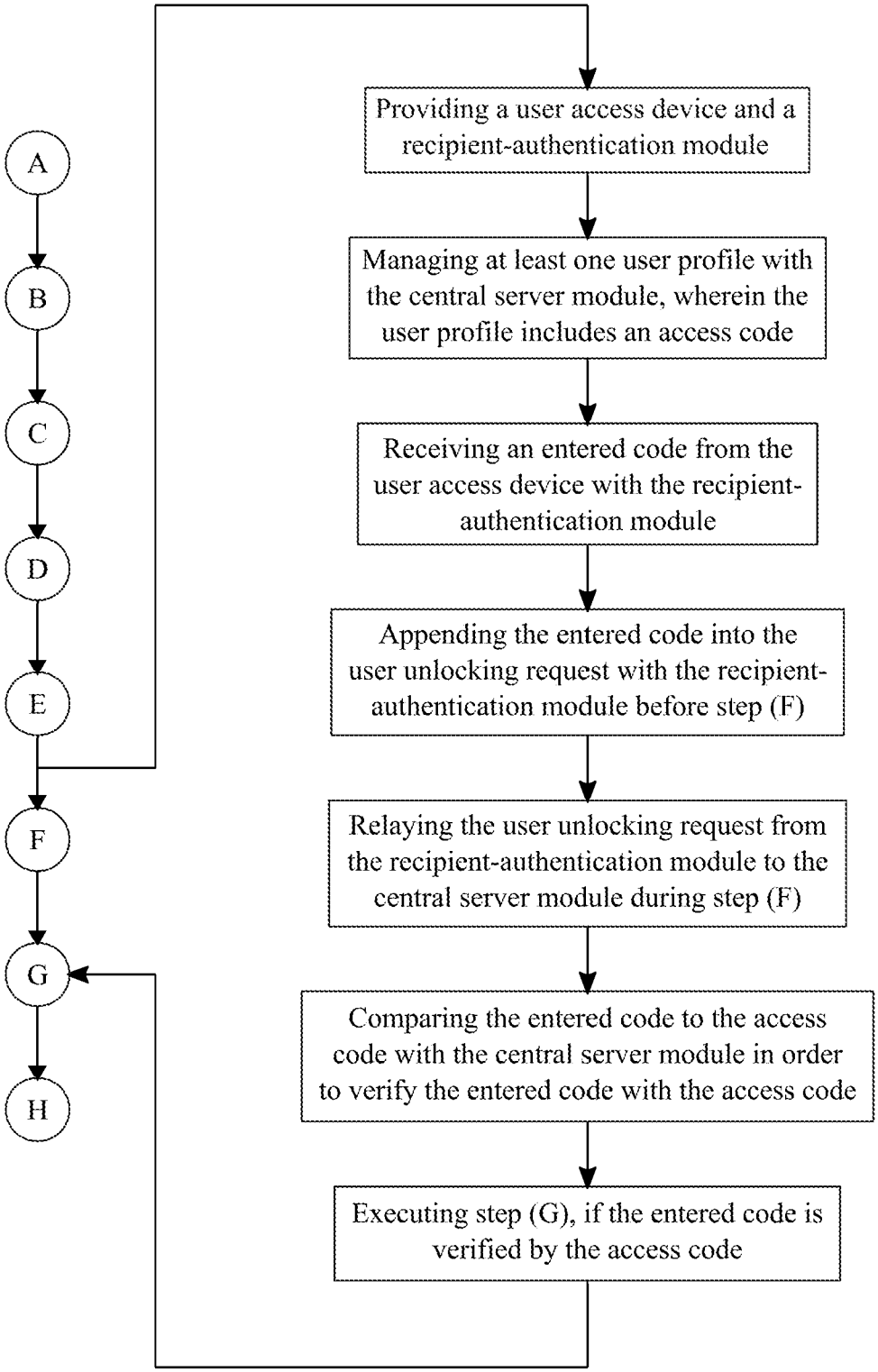
FIG. 7 is a flowchart illustrating the process for executing the recipient-authentication process.

Referring to FIG. 7, further, in the preferred embodiment, a user access device and a recipient-authentication module is provided. The user access device may be a smartphone or a tablet owned by the recipient. Preferably, the user access device may be in wireless communication with the central server module. Alternately, the recipient-authentication module may be an NFC device such as a Bluetooth card enabling close-range communication with the user access device. The central server module manages at least one user profile, wherein the user profile includes an access code. As such, the recipient-authentication module receives an entered code from the user access device. The access code allows access to the computerized dual-access storage box. More specifically, the entered code must be the same as access code in the user profile to gain access to the computerized dual-access storage box. Preferably, this information is sent to the user access device some time before is delivered. Accordingly, the recipient-authentication module appends the entered code into the user unlocking request before step F. Subsequently, the recipient-authentication module relays the user unlocking request to the central server module during step F. Finally, the central server module compares the entered code to the access code in order to verify the entered code with the access code. If the entered code is verified by the access code, step G is executed.

Figure 8:
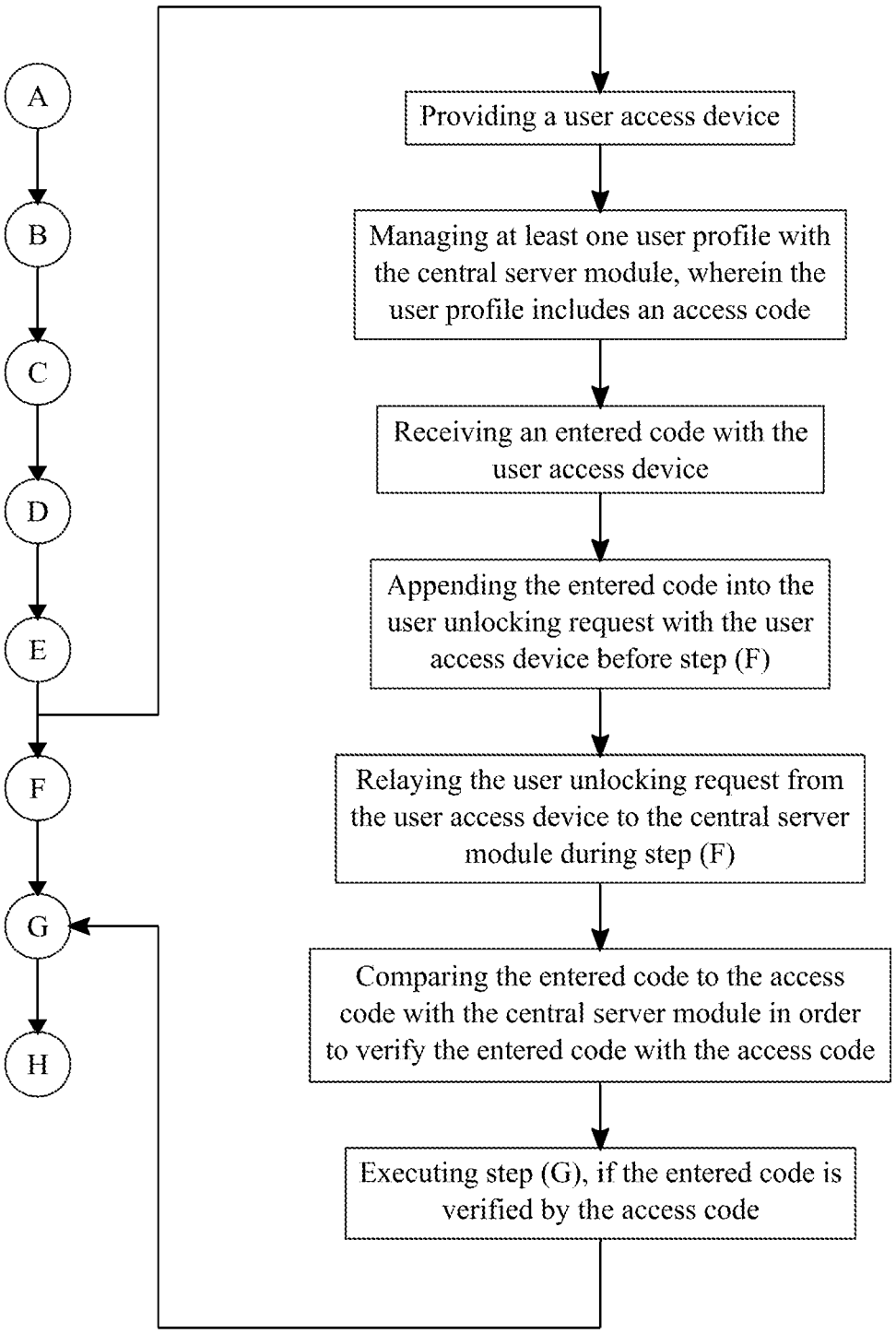
FIG. 8 is a flowchart illustrating the process for executing the recipient-authentication process with the user access device.

Referring to FIG. 8, in another possible embodiment, the entered code is transmitted directly from the user access device to the central server module. As such, the user access device receives an entered code. More specifically, the central server module may send the entered code to the user access device at the time the order is placed. Thus, when the recipient arrives to pick up the delivery, the recipient can use the entered code to unlock the computerized dual-access storage box. As such, the user access device appends the entered code into the user unlocking request before step F. Subsequently, the user access device relays the user unlocking request to the central server module during step F. Preferably, in this embodiment, the authentication process is handled by a mobile application running on the user access device. For instance, the mobile application stores the entered code until the recipient is ready to receive the cargo. Once the recipient nears the computerized dual-access storage box, the mobile application transmits the entered code to the central server module. Accordingly, the central server module compares the entered code to the access code in order to verify the entered code with the access code. Subsequently, step G is executed, if the entered code is verified by the access code. More specifically, the entered code must match the access code in the central server module. This triggers the recipient-side door to automatically open.

Figure 9:
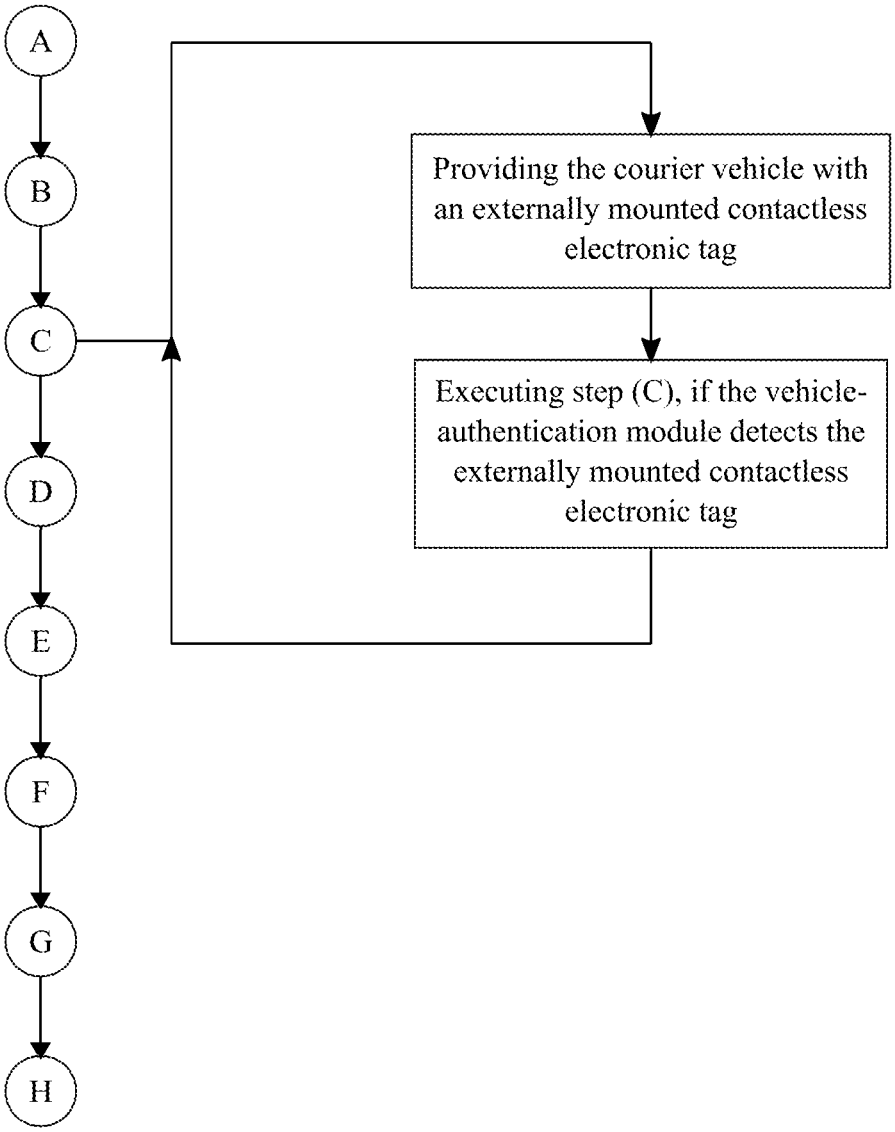
FIG. 9 is a flowchart illustrating the vehicle-authentication process for a courier vehicle equipped with a contactless electronic tag.

Referring to FIG. 9, in an unmanned embodiment of the present invention, the courier vehicle is provided with an externally mounted contactless electronic tag. Accordingly, Step C is executed, if the vehicle-authentication module detects the externally mounted contactless electronic tag.

Figure 10:
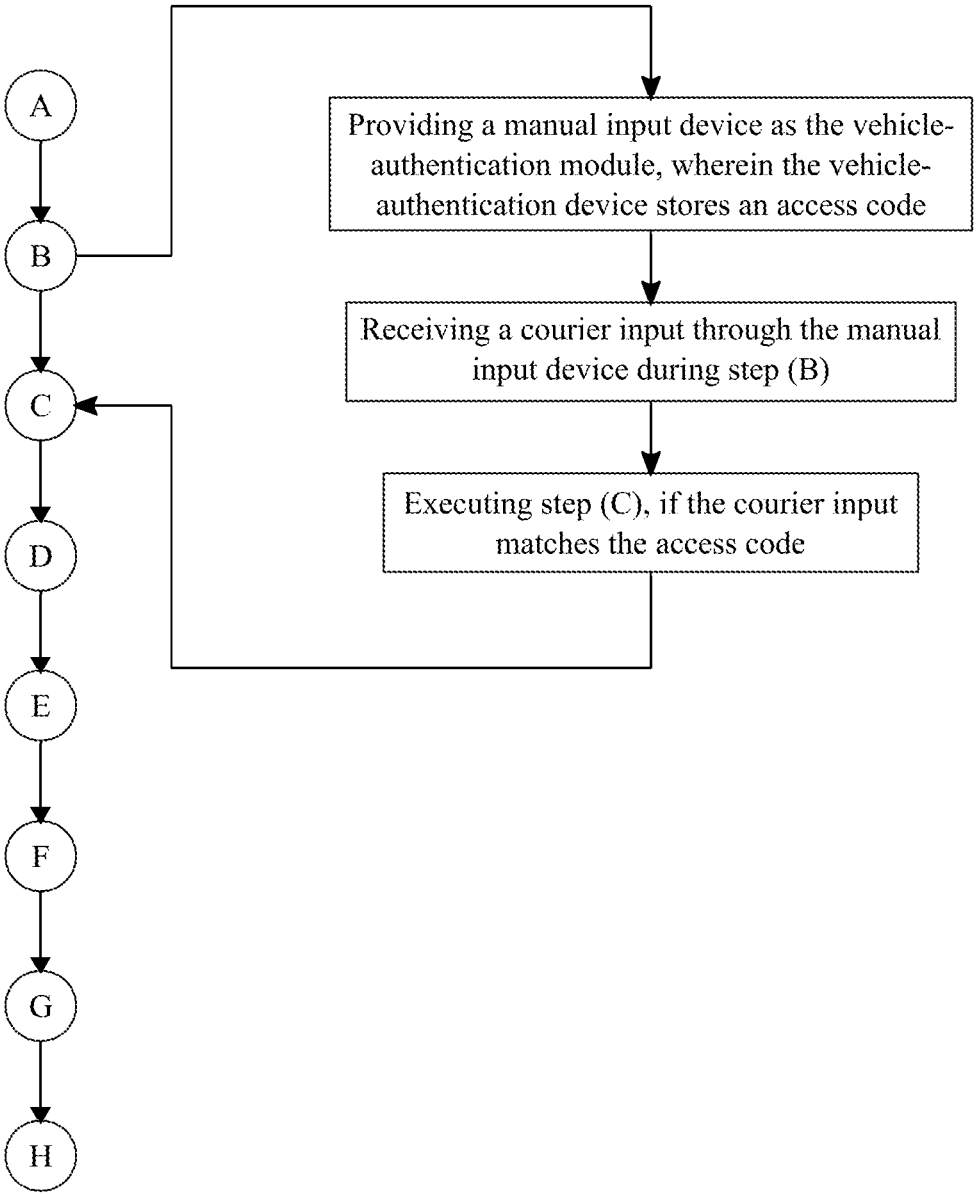
FIG. 10 is a flowchart illustrating the vehicle-authentication process for a manned courier vehicle via a manual input device.

Referring to FIG. 10, in a manned embodiment of the present invention, a manual input device is provided as the vehicle-authentication module, wherein the vehicle-authentication device stores an access code. The manual input device may be a keypad and/or a touchscreen enabling the courier to physically interact with the central server module. The access code is used to give conditional access to the computerized dual-access storage box. Subsequently, the manual input device receives a courier input during step B. The courier input may be a numerical code or a biometric signal which is used as key to grant access to the computerized dual-access storage box. Accordingly, step C is executed, if the courier input matches the access code.

Figure 2:
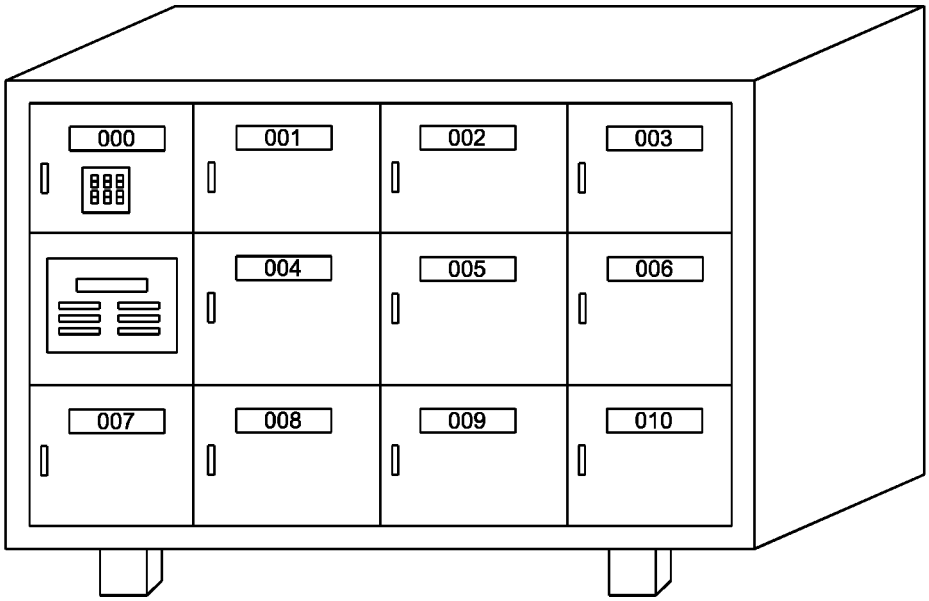
FIG. 2 is an illustration of mailbox for multiple recipients.
Figure 3:
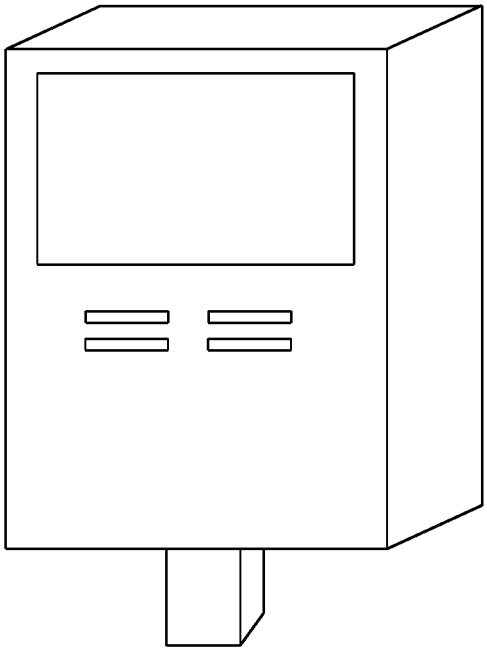
FIG. 3 is an illustration of the distal vehicle-authentication module.
Figure 4:
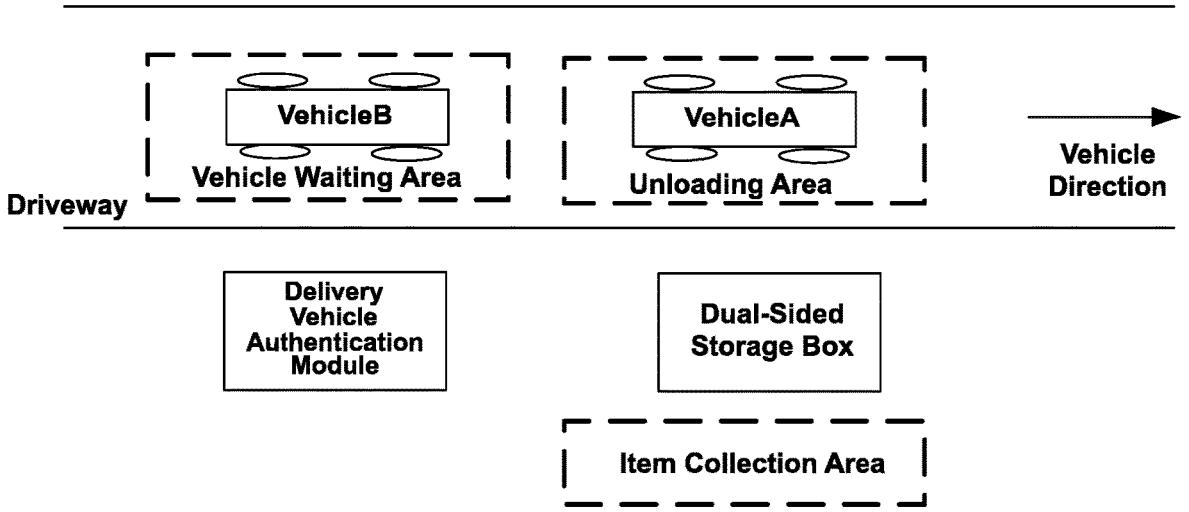
FIG. 4 is a schematic diagram illustrating the position of the first vehicle and the second vehicle.
Figure 11A:
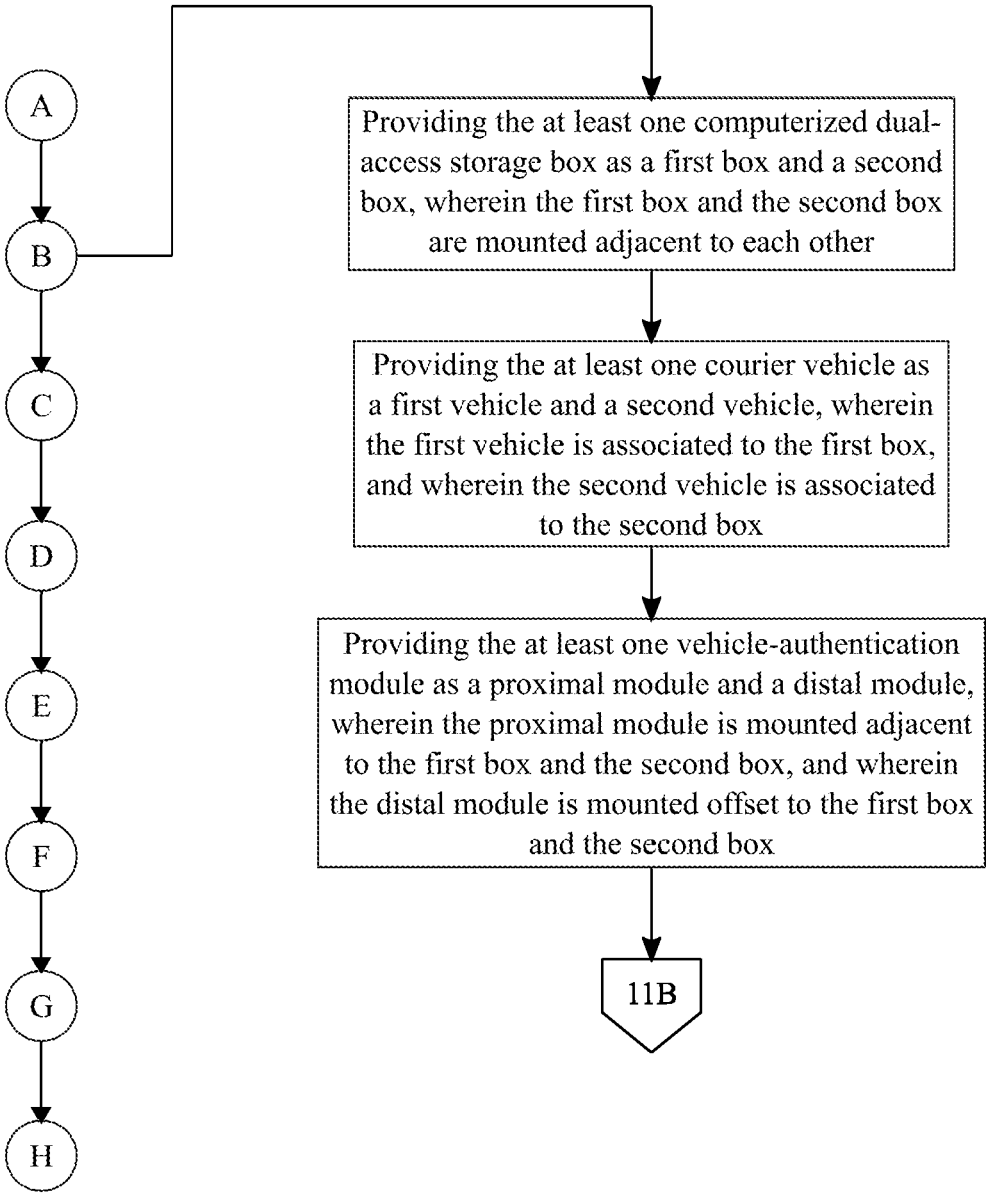
FIG. 11A is a flowchart illustrating the vehicle-authentication process for a first vehicle and a second vehicle.
Figure 11B:
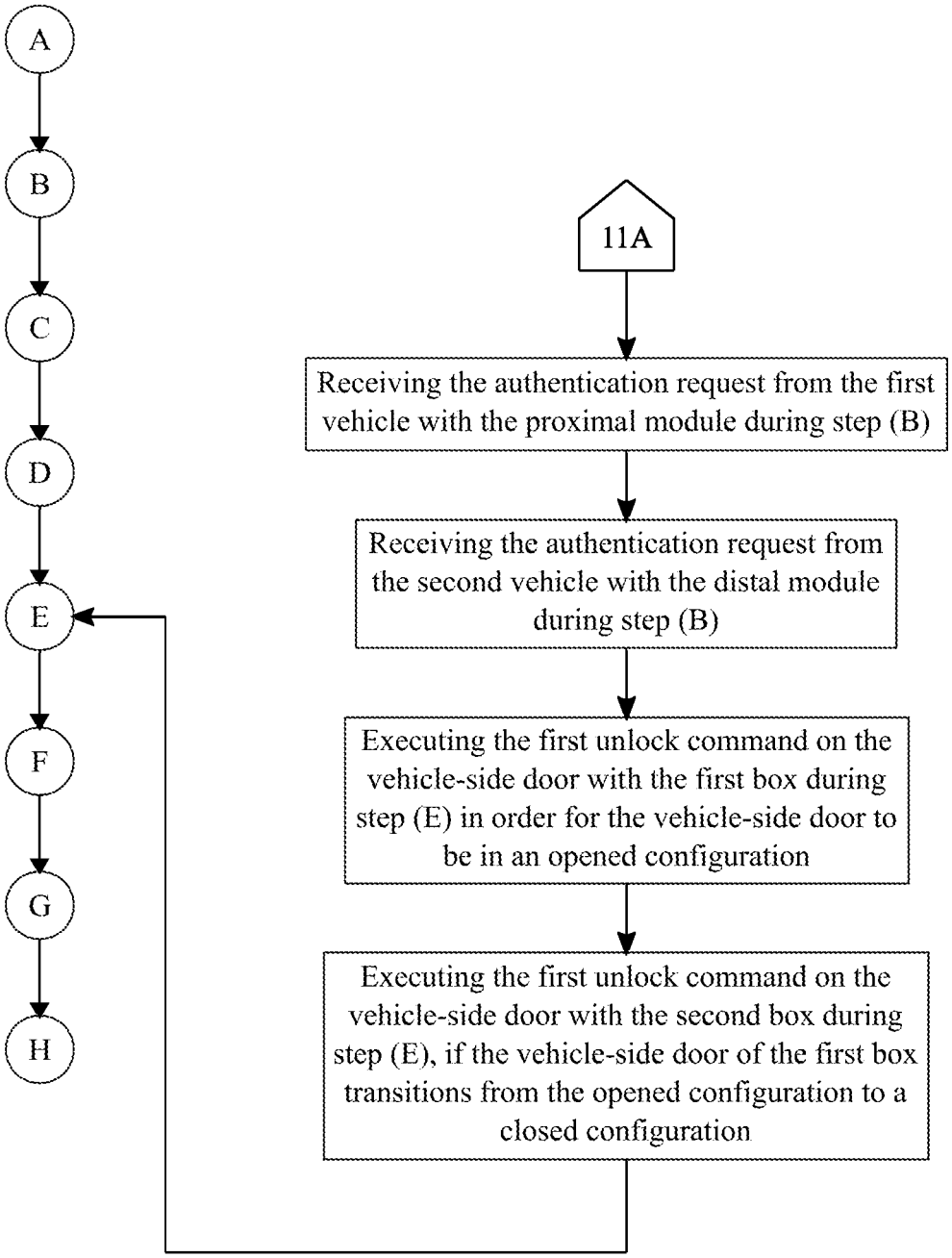
FIG. 11B is a flowchart illustrating the process for executing the first unlock command for the first vehicle and the second vehicle.

Referring to FIG. 4, FIGS. 11A, and 11B, the preferred embodiment of the present invention is also provided with a method of expediting the authentication process for quicker loading. As such, in one possible implementation of the present invention, the at least one computerized dual-access storage box is provided as a first box and a second box, wherein the first box and the second box are mounted adjacent to each other. Similarly, the at least one courier vehicle is provided as a first vehicle and a second vehicle, wherein the first vehicle is associated to the first box, and wherein the second vehicle is associated to the second box. As can be seen in FIG. 2 and FIG. 3, the at least one vehicle-authentication module is provided as a proximal module and a distal module, wherein the proximal module is mounted adjacent to the first box and the second box, and wherein the distal module is mounted offset to the first box and the second box. In one embodiment, the distal module and the proximal module may be NFC transceivers. Likewise, the first vehicle and the second vehicle may be unmanned vehicles equipped with contactless electronic cards. In an alternate embodiment, the first vehicle and the second vehicle may be manned vehicles. Accordingly, the proximal module and the distal module may be a keypad allowing for manual data entry.

In the preferred implementation, the proximal module is mounted on the curbside next to the distal module. The first vehicle and the second vehicle form a line next to the curbside while waiting to load the cargo to the respective first box and second box. While the first vehicle is loading the cargo into the first box, the second vehicle can access the distal module. Accordingly, the proximal module receives the authentication request form the first vehicle during step B. As such, the first box executes the first unlock command on the vehicle-side door during step E in order for the vehicle-side door to be in an opened configuration.

At the same time, the second vehicle has access to the distal module while the first vehicle is using the proximal module. As such, the distal module receives the authentication request from the second vehicle during step B. If the central server module detects that the proximal module is in use by the first vehicle, the second box is put into a standby mode. In the standby mode, the first unlock command for the second box is triggered immediately after the first vehicle loads the first box. As such, the second box executes the first unlock command on the vehicle-side door during step E, if the vehicle-side door of the first box transitions from the opened configuration to a closed configuration. In one possible embodiment, the central server module may delay the first unlock command to enable the first vehicle to depart from the first box. Alternately, the second box may be equipped with a sensor which automatically opens the vehicle-side door if it detects the motion of the second vehicle.

To aid the courier vehicle in accessing the computerized dual-access storage box, a plurality of markers is externally inscribed onto the computerized dual-access storage box. The plurality of markers helps position the courier vehicle for ease of loading. As such, the plurality of markers is positioned offset from each other in order to delineate an ideal parking position for the courier vehicle. More specifically, the plurality of markets delineate the boundary of the ideal parking position. As such, once the ideal parking position gives the courier vehicle a clear access to the vehicle-side door.

For emergency access to the computerized dual-access storage box, a manual access lock is provided. Preferably, the manual access lock is operatively integrated into the vehicle-side door of the computerized dual-access storage box. In one possible embodiment, the manual access lock may be key-operated lock, which bypasses the automatic mechanism for the vehicle-side door and the recipient-side door.

Figure 12:
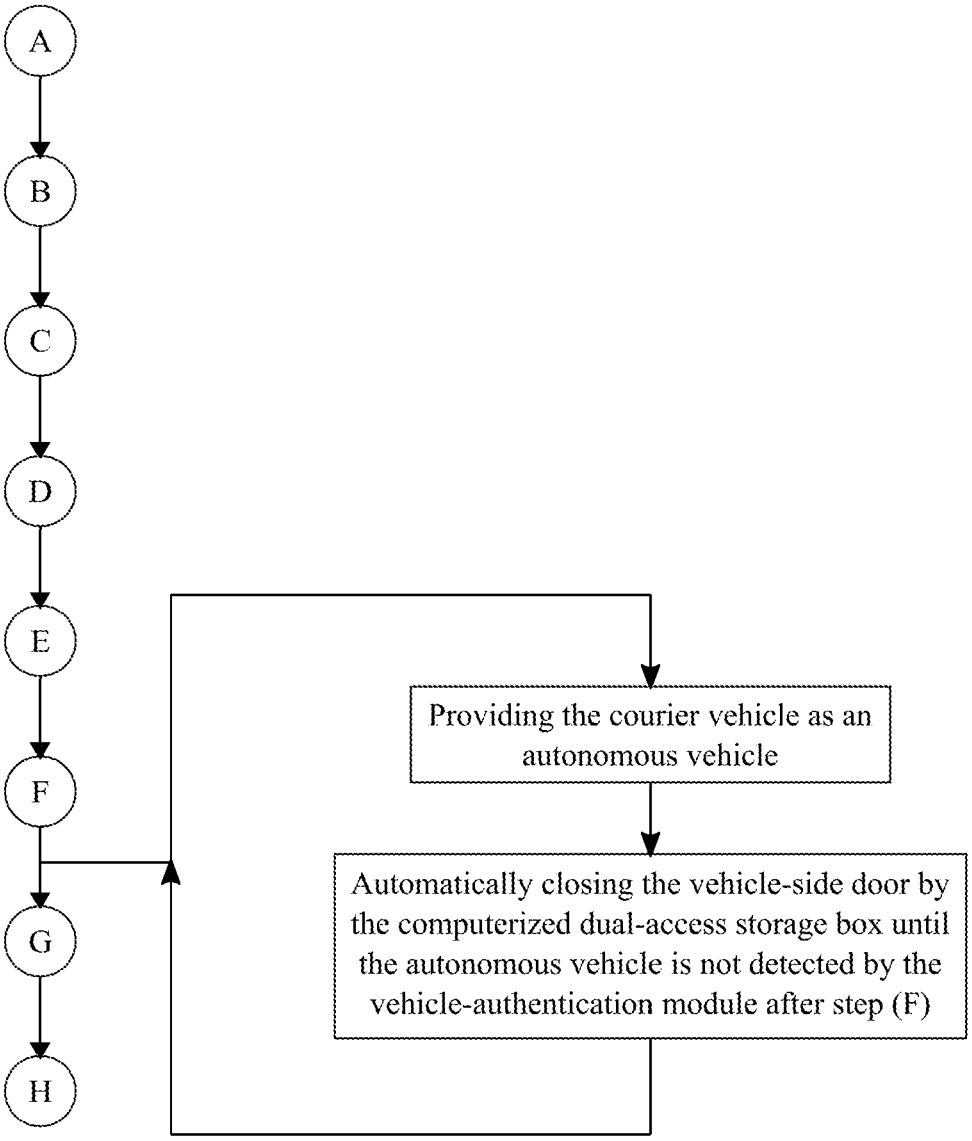
FIG. 12 is a flowchart illustrating the process for closing the vehicle-side door for an autonomous vehicle.
Figure 13:
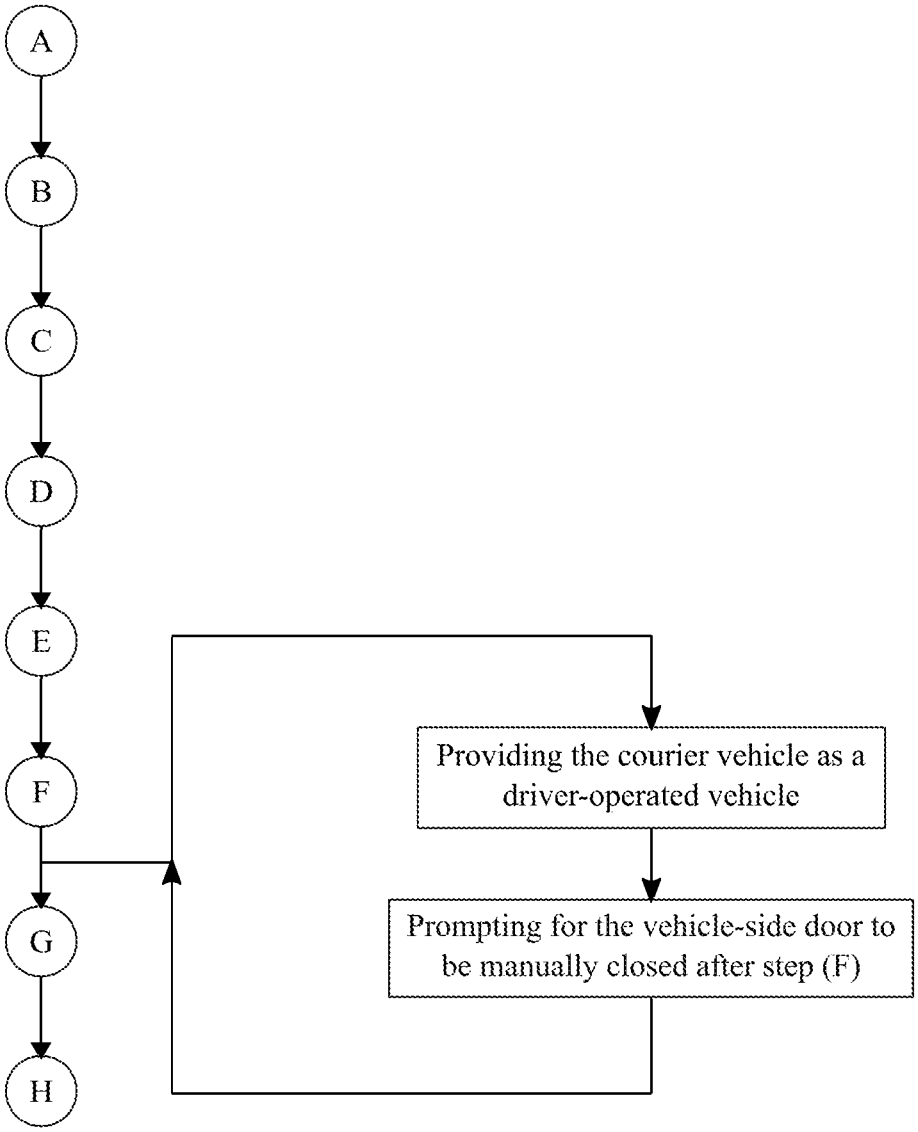
FIG. 13 is a flowchart illustrating the process for closing the vehicle-side door for a driver-operated vehicle.

Referring to FIG. 12 and FIG. 13, in the preferred embodiment, the central server module is responsible for opening the vehicle-side door. However, the closing of the vehicle-side door is dependent on the actions of the courier vehicle. In particular, the courier vehicle must complete the loading process before the vehicle-side door can be closed. In one embodiment, the courier vehicle is an autonomous vehicle, and the vehicle-side door is automatically closed by the computerized dual-access storage box until the autonomous vehicle is not detected by the vehicle-authentication module after step F. For instance, a sensor may detect when a cargo is placed in the computerized dual-access storage box and accordingly close the vehicle-side door. Alternately, in the manned embodiment, the courier vehicle is a driver-operated vehicle. As such, the vehicle-side door prompts to be manually closed after step F. For instance, the vehicle-side door may be closed by pressing a button.

Although the invention has been explained in relation to its preferred embodiment, it is to be understood that many other possible modifications and variations can be made without departing from the spirit and scope of the invention as hereinafter claimed.

What is claimed is:

1. A method for shipping and handling of goods based on automatically operated, dual-access storage boxes, the method comprising the steps of:

(A) providing at least one computerized dual-access storage box, at least one vehicle-authentication module, a central server module, and at least one courier vehicle, wherein the computerized dual-access storage box is mounted onto a curbside, and wherein the computerized dual-access storage box comprises a vehicle-side door and a recipient-side door, and wherein the vehicle-side door and the recipient-side door are electronically connected to the central server module;

(B) receiving an authentication request from the courier vehicle with the vehicle-authentication module;

(C) relaying an authentication confirmation from the vehicle-authentication module to the central server module, if the authentication request is verified by the vehicle-authentication module;

(D) relaying a first unlock command from the central server module to the computerized dual-access storage box, if the authentication confirmation is relayed to the central server module;

(E) executing the first unlock command on the vehicle-side door with the computerized dual-access storage box;

providing the at least one computerized dual-access storage box as a first box and a second box, wherein the first box and the second box are mounted adjacent to each other;

providing the at least one courier vehicle as a first vehicle and a second vehicle, wherein the first vehicle is associated to the first box, and wherein the second vehicle is associated to the second box;

providing the at least one vehicle-authentication module as a proximal module and a distal module, wherein the proximal module is mounted adjacent to the first box and the second box, and wherein the distal module is mounted offset to the first box and the second box;

receiving the authentication request from the first vehicle with the proximal module during step (B);

receiving the authentication request from the second vehicle with the distal module during step (B);

executing the first unlock command on the vehicle-side door with the first box during step (E) in order for the vehicle-side door to be in an opened configuration;

executing the first unlock command on the vehicle-side door with the second box during step (E), if the vehicle-side door of the first box transitions from the opened configuration to a closed configuration;

(F) receiving a user unlocking request with the central server module;

(G) relaying a second unlock command from the central server module to the computerized dual-access storage box, if the user unlocking request is verified by the central server module;

(H) executing the second unlock command on the recipient-side door with the computerized dual-access storage box.

2. The method for shipping and handling of goods based on automatically operated, dual-access storage boxes, the method as claimed in claim 1 comprising the steps of:

managing a schedule for the computerized dual-access storage box with the central server module, wherein the courier vehicle is assigned a designated timeslot within the schedule;

managing a current time with the central server module;

verifying the authentication request from the courier vehicle with the vehicle-authentication module, if the current time is within the designated time slot of the courier vehicle during step (B).

3. The method for shipping and handling of goods based on automatically operated, dual-access storage boxes the method as claimed in claim 1 comprising the steps of:

providing a user access device and a recipient-authentication module;

managing at least one user profile with the central server module, wherein the user profile includes an access code;

receiving an entered code from the user access device with the recipient-authentication module;

appending the entered code into the user unlocking request with the recipient-authentication module before step (F);

relaying the user unlocking request from the recipient-authentication module to the central server module during step (F);

comparing the entered code to the access code with the central server module in order to verify the entered code with the access code;

executing step (G), if the entered code is verified by the access code.

4. The method for shipping and handling of goods based on automatically operated, dual-access storage boxes the method as claimed in claim 1 comprising the steps of:

providing a user access device;

managing at least one user profile with the central server module, wherein the user profile includes an access code;

receiving an entered code with the user access device;

appending the entered code into the user unlocking request with the user access device before step (F);

relaying the user unlocking request from the user access device to the central server module during step (F);

comparing the entered code to the access code with the central server module in order to verify the entered code with the access code;

executing step (G), if the entered code is verified by the access code.

5. The method for shipping and handling of goods based on automatically operated, dual-access storage boxes the method as claimed in claim 1 comprising the steps of:

providing the courier vehicle with an externally mounted contactless electronic tag;

executing step (C), if the vehicle-authentication module detects the externally mounted contactless electronic tag.

6. The method for shipping and handling of goods based on automatically operated, dual-access storage boxes the method as claimed in claim 1 comprising the steps of:

providing a manual input device as the vehicle-authentication module, wherein the vehicle-authentication device stores an access code;

receiving a courier input through the manual input device during step (B);

executing step (C), if the courier input matches the access code.

7. The method for shipping and handling of goods based on automatically operated, dual-access storage boxes the method as claimed in claim 1, wherein a plurality of markers is externally inscribed onto the computerized dual-access storage box, and wherein the plurality of markers is positioned offset from each other in order to delineate an ideal parking position for the courier vehicle.

8. The method for shipping and handling of goods based on automatically operated, dual-access storage boxes the method as claimed in claim 1, wherein a manual access lock is operatively integrated into the vehicle-side door of the computerized dual-access storage box.

9. The method for shipping and handling of goods based on automatically operated, dual-access storage boxes the method as claimed in claim 1, wherein the courier vehicle is an autonomous vehicle, and wherein the vehicle-side door is automatically closed by the computerized dual-access storage box until the autonomous vehicle is not detected by the vehicle-authentication module after step (F).

10. The method for shipping and handling of goods based on automatically operated, dual-access storage boxes the method as claimed in claim 1, wherein the courier vehicle is a driver-operated vehicle, and wherein the vehicle-side door prompts to be manually closed after step (F).

* * * * *